US011001947B2

(12) United States Patent
Amis et al.

(10) Patent No.: US 11,001,947 B2
(45) Date of Patent: May 11, 2021

(54) ARTICLES WITH INTEGRALLY KNIT HEAT-TREATABLE YARN

(71) Applicant: NIKE, Inc., Beaverton, OR (US)

(72) Inventors: Hannah R. Amis, Portland, OR (US); Dallas Lund, Portland, OR (US); Amy Lyttle, Portland, OR (US)

(73) Assignee: Nike, Inc., Beaverton, OR (US)

( * ) Notice: Subject to any disclaimer, the term of this patent is extended or adjusted under 35 U.S.C. 154(b) by 489 days.

(21) Appl. No.: 15/807,010

(22) Filed: Nov. 8, 2017

(65) Prior Publication Data

US 2018/0127905 A1 May 10, 2018

Related U.S. Application Data

(60) Provisional application No. 62/419,447, filed on Nov. 8, 2016.

(51) Int. Cl.

| | |
|---|---|
| ***D04B 21/12*** | (2006.01) |
| ***D04B 9/54*** | (2006.01) |
| ***D04B 1/26*** | (2006.01) |
| ***D04B 1/12*** | (2006.01) |

(52) U.S. Cl.

CPC ..... *D04B 21/12* (2013.01); *D04B 1/12* (2013.01); *D04B 1/26* (2013.01); *D04B 9/54* (2013.01); *D10B 2401/041* (2013.01)

(58) Field of Classification Search

CPC ..... D04B 21/12; D04B 1/12; D04B 1/26

See application file for complete search history.

(56) References Cited

U.S. PATENT DOCUMENTS

| | | | | | |
|---|---|---|---|---|---|
| 1,888,172 | A | * | 11/1932 | Joha | A43B 1/02 66/177 |
| 1,910,251 | A | * | 5/1933 | Joha | D04B 1/24 66/177 |
| 2,001,293 | A | * | 5/1935 | Wilson | A43B 1/04 66/171 |
| 2,047,724 | A | * | 7/1936 | Zuckerman | A43B 1/04 66/177 |
| 2,102,369 | A | | 12/1937 | Martel | |

(Continued)

FOREIGN PATENT DOCUMENTS

| | | | |
|---|---|---|---|
| CN | 2645464 | Y | 10/2004 |
| CN | 102100411 | A | 6/2011 |

(Continued)

OTHER PUBLICATIONS

International Preliminary Report on Patentability dated May 23, 2019 in International Patent Application No. PCT/US2017/060649, 11 pages.

(Continued)

*Primary Examiner* — Danny Worrell

(74) *Attorney, Agent, or Firm* — Shook, Hardy & Bacon, L.L.P.

(57) ABSTRACT

An article with heat-treatable thermoplastic yarn includes various features. The article may include knit structures that at least partially affect rigidity in a zone that includes thermoplastic yarn. In addition, the article may include knit structures that at least partially affect elasticity in a zone that that includes thermoplastic yarn.

20 Claims, 5 Drawing Sheets

(56) References Cited

U.S. PATENT DOCUMENTS 2,608,078 A * 8/1952 Anderson ..... D04B 1/16 66/176
2,811,029 A * 10/1957 Conner ..... D04B 1/06 66/172 R
3,793,851 A 2/1974 Thorneburg
3,796,066 A * 3/1974 Millar ..... D04B 1/08 66/95
4,320,634 A * 3/1982 Hashimoto ..... A41D 27/06 66/202
4,502,513 A * 3/1985 Mueller ..... D03D 47/50 139/383 R
4,733,545 A * 3/1988 Weinle ..... D04B 21/18 66/202
4,750,339 A * 6/1988 Simpson, Jr. ..... D02G 3/32 66/172 R
4,842,661 A * 6/1989 Miller ..... A41D 27/245 156/88
5,708,985 A 1/1998 Ogden
5,832,539 A 11/1998 Williams
6,032,295 A 3/2000 Marshall
6,158,253 A * 12/2000 Svoboda ..... A41B 11/004 2/239
6,308,337 B1 10/2001 Penley
6,477,865 B1 11/2002 Matsumoto
6,571,397 B1 6/2003 Williams
6,910,288 B2 * 6/2005 Dua ..... A43B 1/04 36/45
7,823,420 B2 * 11/2010 Andrieu ..... F16L 57/06 66/170
8,069,692 B2 * 12/2011 Chung ..... D04B 1/24 66/172 E
8,490,436 B2 * 7/2013 Chung ..... D04B 1/106 66/172 E
8,997,529 B1 * 4/2015 Podhajny ..... A43B 23/042 66/177
9,084,449 B2 7/2015 Bell et al.
9,371,603 B2 * 6/2016 Meir ..... D04B 1/22
2002/0120972 A1 9/2002 Nakamura et al.
2002/0148258 A1 * 10/2002 Cole ..... A43B 23/0255 66/202
2006/0065353 A1 3/2006 Williams
2008/0222778 A1 9/2008 Dierssen-Morice et al.
2011/0041232 A1 2/2011 Covelli et al.
2012/0058316 A1 3/2012 Cherneski
2012/0102625 A1 5/2012 Klein
2012/0279260 A1 * 11/2012 Dua ..... D04B 1/16 66/171
2013/0180027 A1 7/2013 Rock
2013/0260104 A1 * 10/2013 Dua ..... B29C 65/72 428/175
2014/0068968 A1 3/2014 Podhajny
2014/0090273 A1 4/2014 Piontkowski
2017/0029989 A1 * 2/2017 Tuscia ..... B32B 27/12
2018/0127905 A1 * 5/2018 Amis ..... D04B 1/12
2018/0343955 A1 * 12/2018 Li ..... D04B 1/22
2018/0343956 A1 * 12/2018 Li ..... D04B 1/108

FOREIGN PATENT DOCUMENTS

CN 103330294 A 10/2013
CN 104106872 A 10/2014
CN 103564663 B 7/2015
CN 204742767 U 11/2015
EP 1813159 A1 8/2007
GB 914306 A 1/1963
JP 3156544 U 1/2010
KR 20100003407 U 9/2008
WO 2012067645 A1 5/2012
WO 2012091503 A2 7/2012
WO 2014194395 A1 12/2014

OTHER PUBLICATIONS

MCB Combat Boot Socks, thorlo.com; Jul. 13, 2016, 3 pages. https://web.archive.org/web/20160713220759/https:/www.thodo.com/socks/mcb/404.

Full Cushion Steel-Toe Cotton Work Boot Sock, carhartt.com, Jan. 11, 2016, 3 pages. https://web.archive.org/web/20160111061505/http:/www.carhartt.com/products/Full-Cushion-Steel-Toe-Cotton-Work-Boot-Sock-A555.

TRHXM Men Trail Hiking Socks, thorlo.com; Jul. 30, 2014, 7 pages. https://web.archive.org/web/20140730053541/https:/www.thorlo.com/socks/trhxm.

International Search Report and Written Opinion dated Jan. 25, 2018 in International Patent Application No. PCT/US2017/060649, 20 pages.

Office Action received for European Patent Application No. 17804379.0, dated Mar. 9, 2021, 6 pages.

* cited by examiner

ARTICLES WITH INTEGRALLY KNIT HEAT-TREATABLE YARN

CROSS-REFERENCE TO RELATED APPLICATIONS

This application, entitled "ARTICLES WITH INTEGRALLY KNIT HEAT-TREATABLE YARN," filed on Nov. 8, 2017, and assigned U.S. application Ser. No. 15/807,010, claims the benefit of priority to U.S. Provisional Application No. 62/419,447, filed on Nov. 8, 2016, entitled "ARTICLES WITH INTEGRALLY KNIT HEAT-TREATABLE YARN," the entirety of which is incorporated herein by reference.

TECHNICAL FIELD

This application is related to articles knit with one or more yarn types that are treated to include article-enhancing properties. Examples of yarns include heat-treatable yarns, moisture-wicking yarns (e.g., hydrophilic), water-repellant yarns (e.g., hydrophobic), and the like.

BACKGROUND

A variety of products and clothing garments may include one or more knit layers that are typically constructed from one or more yarn types. The one or more knit layers may include features and properties that result from the knit structure, the yarn types(s), and various other factors.

SUMMARY

In brief, and at a high level, aspects herein are directed towards articles including a knit textile layer that may be constructed from one or more yarns that have been enhanced to provide certain properties, and in exemplary aspects, an enhanced yarn may include a thermoplastic yarn, which may be integrally knit into selected portions of the knit textile layer. Moreover, the knit textile layer may be incorporated into various types of products such as clothing garments, and in some aspects, a clothing garment may have properties and features at areas that include the knit textile layer integrally knit with the thermoplastic yarn. Further, the knit textile layer may be selectively located in the clothing garment in order to provide properties and features to certain areas.

Aspects of the invention are defined by the claims below, not this summary. A high-level overview of various aspects is provided here to introduce a selection of concepts that are further described in the detailed-description section below. This summary is not intended to identify key features or essential features of the claimed subject matter, nor is it intended to be used as an aid in isolation to determine the scope of the claimed subject matter.

BRIEF DESCRIPTION OF THE DRAWINGS

Subject matter of this application is described in detail herein with reference to the attached drawing figures, which are incorporated herein by reference in their entirety, wherein.

DETAILED DESCRIPTION

Figure 1:
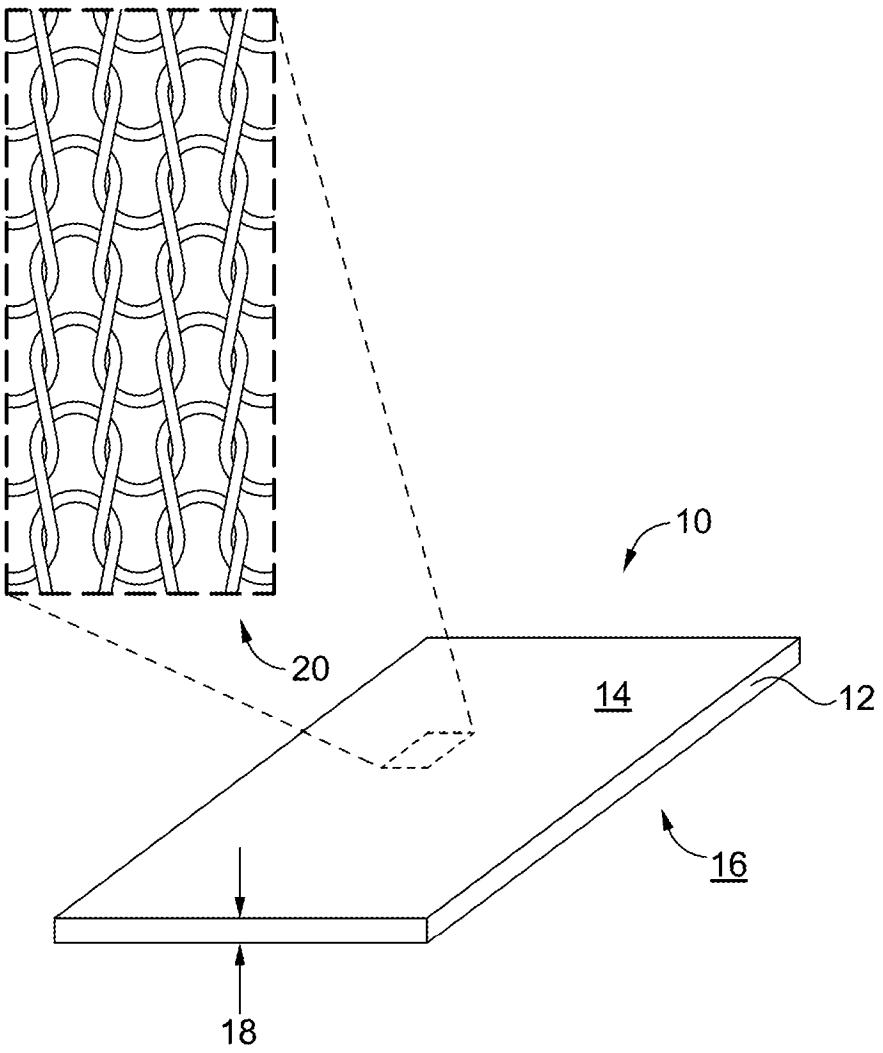
FIG. 1 is a schematic view of a knit textile layer in accordance with an aspect of this disclosure.

Subject matter is described throughout this disclosure in detail and with specificity in order to meet statutory requirements. But the aspects described throughout this disclosure are intended to be illustrative rather than restrictive, and the description itself is not intended necessarily to limit the scope of the claims. Rather, the claimed subject matter might be practiced in other ways to include different elements or combinations of elements that are equivalent to the ones described in this disclosure. In other words, the intended scope of the invention includes equivalent features, aspects, materials, methods of construction, and other aspects not expressly described or depicted in this application in the interests of concision, but which would be understood by an ordinarily skilled artisan in the relevant art in light of the full disclosure provided herein as being included within the inventive scope. It will be understood that certain features and subcombinations are of utility and may be employed without reference to other features and subcombinations. This is contemplated by and is within the scope of the claims.

This disclosure generally describes knit textile layers constructed to include one or more yarns that have been enhanced to provide certain properties. Yarns may be enhanced in various manners, and examples of enhanced yarns include thermoplastic yarns, moisture-wicking yarns, moisture-repellant yarns, and the like. Knit textile layers having enhanced yarns may be incorporated into various types of products, such as garments, bags, equipment, and the like. Exemplary garments that may be at least partially constructed of knit textile layers having enhanced yarns include footwear, socks, pants, shorts, shirts, under garments, bras, base layers, outer layers, coats, jackets, arm sleeves, leg sleeves, and the like. The garments, and other articles described throughout this disclosure, are merely exemplary, and other articles not expressly described in this disclosure may also include knit textile layers constructed of enhanced yarns and are also deemed within the scope of this disclosure.

Knit Textile Layers Having Thermoplastic Yarns—Some General Aspects

Some aspects of this disclosure relate to a knit textile layer that is constructed to include an integrally knit, thermoplastic yarn. As used throughout this disclosure, a thermoplastic yarn ("TP yarn") refers to a yarn that is coated with, or otherwise made to include, a thermoplastic polymer composition. The thermoplastic polymer composition may include a melting temperature within an exemplary range from about 85° C. to about 230° C. and therefore, may melt or deform (and subsequently solidify) when heated or thermoformed. In further aspects, the melting temperature of the thermoplastic polymer composition may be such that a structure of the melt yarn may be maintained during a commercial knitting process and during conventional dyeing techniques. It should be noted that the melting temperature may be lower or higher than the exemplary range and encompasses the varying melting temperatures of the multiple thermoplastic polymer compositions contemplated herein.

Moreover, before or after forming or knitting a garment, the TP yarn may be heat-treated or thermoformed, which causes an area of the garment including the melt yarn to then include a coat of film, which may provide certain properties or characteristics. For example, the film may provide some impact attenuation, abrasion or wear resistance, friction reduction, and the like. A thermoplastic yarn may also be referred to as a "melt yarn," which refers to the nature of the yarn in which at least a portion of the yarn changes states at a particular temperature and then hardens upon cooling to a solid state.

A TP yarn may be integrally constructed into a knit textile layer in various manners, and referring now to FIG. 1, a schematic diagram is provided to help illustrate some aspects of this disclosure. In FIG. 1, a knit textile layer is generally denoted by reference numeral 10, and in the context of this disclosure, the knit textile layer 10 includes a knit wall 12. The knit wall 12 conceptually represents one or more yarns that are knit together to form a knit structure having a first side 14, a second side 16, and a thickness 18 between the first side 14 and the second side 16. For instance, the knit wall 12 generally includes a series of courses, which are conceptually similar to rows in a grid-like structure. Furthermore, each course includes a set of stitches, stitch positions, needles, or needle positions that are sometimes referred to as wales in some knitting methods and that are generally aligned with corresponding needle positions of adjacent courses. In this respect, the aligned corresponding needle positions are conceptually similar to columns in a grid-like structure. As used in this description, a needle position in a knit textile layer refers to a position at which a stitch is located and may also be referred to as a stitch position.

The courses and needles of the knit wall 12 may be knit together using various techniques. For example, the magnified view 20 depicts a single-knit structure. In addition, alternative knitting techniques might be used to build the knit wall 12 having different knit structures, such as a double knit, plaited stitches, terry stitches, floats, and the like. In each of these alternatives the knit textile layer 10 includes the conceptual knit wall 12, or base structure, enhanced with one or more additional knit structures, and the knit wall 12 includes the first side 14, the second side 16, and the thickness 18, which is formed of courses and needle positions. In these alternative structures, the actual structure (i.e., depicted in the magnified view) would change accordingly.

The properties of the knit wall 12 might be regulated by constructing different regions (e.g., courses) with different yarns. And when a thermoplastic yarn that is integrated into a knit textile layer is transformed into a solid state, such as when heat is applied and the yarn is allowed to cool (e.g., heat-set or thermoformed), characteristics of the knit textile layer may be altered. For instance, a heat-treated TP yarn that has been cooled and has hardened might increase an overall rigidity of the knit textile layer. In addition, when the thermoplastic yarn is melted and then cooled, the hardened thermoplastic may at least partially coat other yarns included in the knit textile layer to effectively "lock" the other yarns and impede at least some elasticity.

The properties of the knit wall 12 can be at least partially regulated by dictating the placement of TP yarn, as well as the type of knit structure or stitch into which a TP yarn is formed. For example, in one type of knit structure, only TP yarn may be used to construct all of the courses of a knit wall, such that when the TP yarn is heated and cooled, the entire knit wall is formed of the heat-treated TP yarn that has been cooled and has hardened. In this example, depending on the structure of the TP yarn and the extent to which the TP yarn is melted, the TP yarn may solidify into a film or thermoplastic sheet. As such, the TP yarn may not possess a traditional elongated yarn strand body, and instead may include the film, or some combination of the film with part of the yarn strand body. While this type of TP-yarn knit structure with only TP yarn may be useful in many instances, in other aspects it may be desirable to regulate the extent to which certain properties of the knit wall (e.g., rigidity and elasticity) are modified by the heat-treated TP yarn. As such, in some aspects of this disclosure, both non-TP yarn and TP yarn is selectively knit into the knit textile layer in one or more patterns and/or using one or more techniques in order to at least partially regulate the extent to which the heat-treated TP yarn affects the rigidity, elasticity, and other properties of the knit textile layer.

Figure 2:
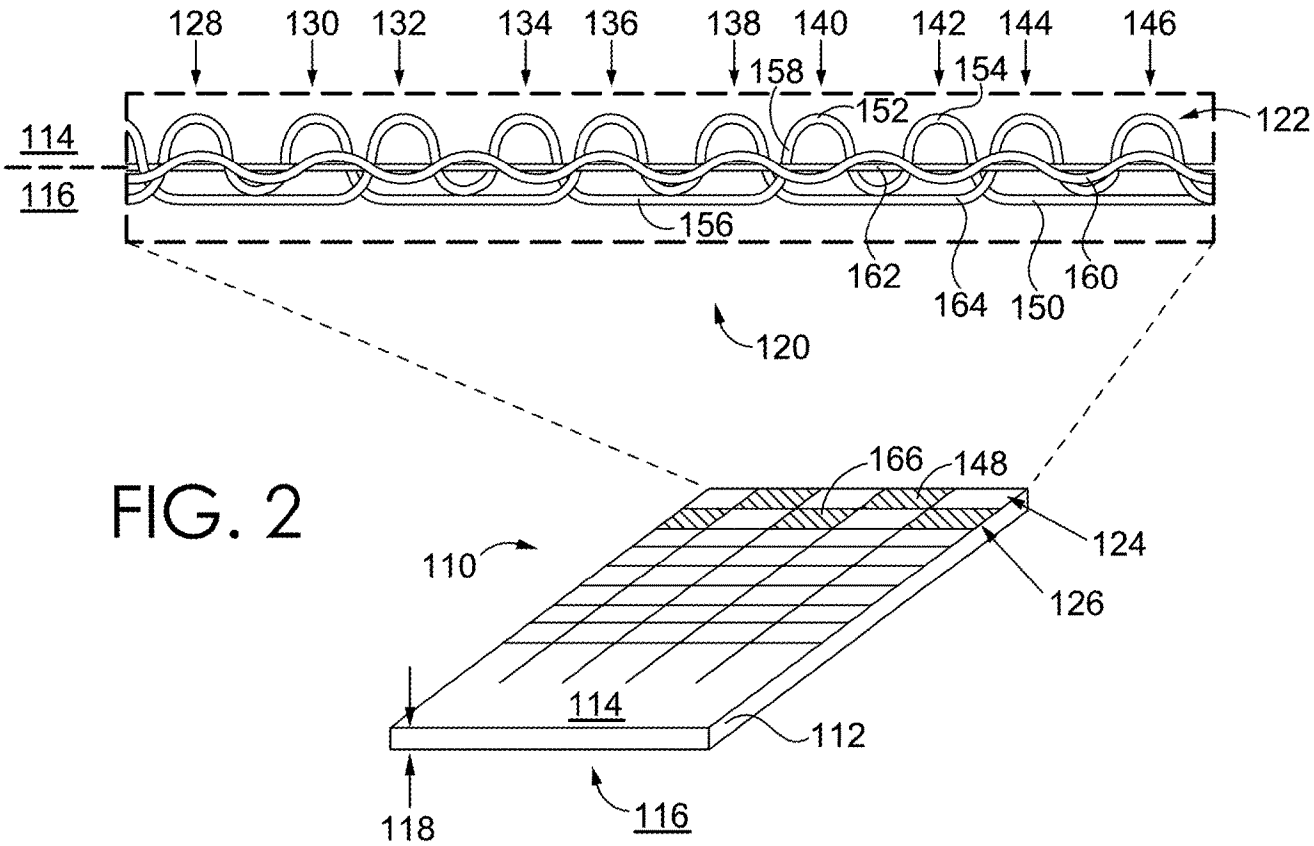
FIG. 2 is a schematic view of another knit textile layer in accordance with an aspect of this disclosure.

Knit Textile Layers Having Thermoplastic Yarns—Some Aspects of Needle-Subset and Course Configurations As indicated above, in one or more aspects of the present disclosure, a knitting technique is applied that may at least partially regulate how a heat-treated TP yarn affects the systematic properties of a knit wall. Referring now to FIG. 2, a knit textile layer 110 is depicted that is similar in some respects to the knit wall 12 depicted in FIG. 1. For example, the knit textile layer 110 includes a knit wall 112 with a first side 114 and a second side 116. In addition, the knit wall 112 includes a thickness 118 between the first side 114 and the second side 116.

In accordance with an aspect of the present invention, the TP yarn is knit into the knit wall 112 by arranging a first portion of the TP yarn on the first side 114 of the knit wall 112 and a second portion of the TP yarn on the second side 116 of the knit wall 112. Furthermore, the TP yarn includes another portion that connects the first portion to the second portion and that passes through the thickness 118, from the first side 114 to the second side 116. The first portion of the TP yarn is identified in the knit wall 112 by reference numeral 148, which labels the schematic representation of the first portion (i.e., box with hatching) in the knit wall 112. By adjusting the arrangement of the TP yarn at different needle positions along a single course (i.e., alternating from one side to the other side), the knit wall 112 may be less rigid than if the TP yarn were positioned on a single side throughout the entire course.

FIG. 2 also includes a magnified view 120 depicting an exemplary knit structure 122 that could be used to arrange a TP yarn strand 150 on the first side 114 and on the second side 116 in an alternating manner. The magnified view 120 illustrates various needle positions (e.g., 128-146), and needle positions 140 and 142 including TP-yarn stitches 152 and 154, respectively, make up the first portion 148 identified in the knit wall 112. Furthermore, the TP yarn includes a TP-yarn float portion 156 that traverses needle positions 136 and 138 and that is positioned on the second side 116. The TP-yarn float portion 156 is connected to the TP-yarn stitch 152 by a length 158 of the TP yarn.

The knit structure 122 includes other yarns as well that form the knit wall 112. For example, the knit structure 122 includes a plaiting yarn 160 (e.g., binding yarn) and a laid-in yarn 162, as well as another body yarn 164. In accordance with an aspect of this disclosure, when the TP yarn 150 is positioned on the first side (e.g., stitches 152 and 154), the body yarn 164 is arranged on the second side 116. And in the exemplary configuration of FIG. 2, the body yarn 164 is floated on the second side 116.

Figure 3:
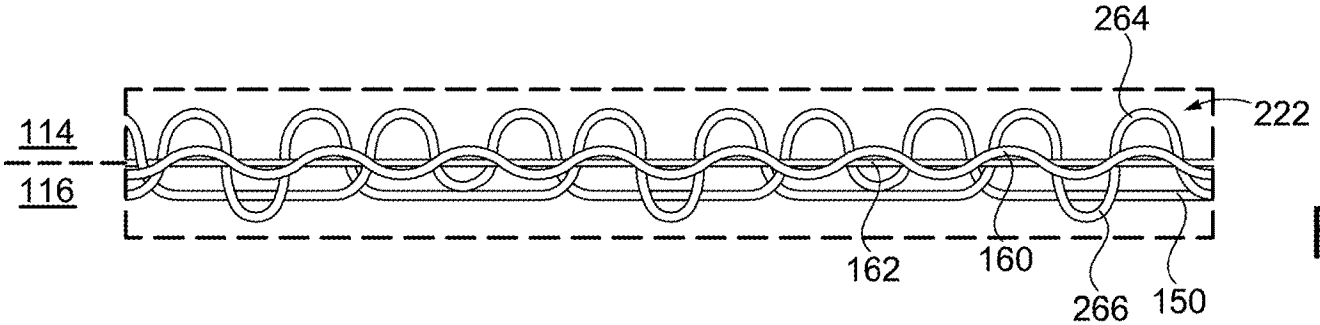
FIG. 3 is a schematic view of a knit structure that is an alternative to the knit structure depicted in FIG. 2, in accordance with an aspect of this disclosure.

While the knit structure 122 represents one type of knit arrangement that might be used to integrally knit TP yarn 150 into a knit wall 112, other knit arrangements are also possible. For example, one or more of the yarns 160, 162, 164 may be changed, or omitted. In addition, one or more yarns may be added to the knit structure 122 depicted in the magnified portion. An alternative knit structure 222 is depicted by FIG. 3, which is similar to the knit structure 122 of FIG. 2. That is, the structure 222 is similar in that it includes the TP yarn 150, the plaiting yarn 160, and the laid-in yarn 162. However, in accordance with an aspect of the disclosure, the structure 222 includes a body yarn 264 that is knitted to include an additional terry loop 266, which is brought to the second side 116. As such, the terry loop 266 may help to cushion the heat-treated TP yarn 150 on the second side 116, which may face towards a wearer when the knit wall 112 is knit into a garment that is worn.

Figure 4:
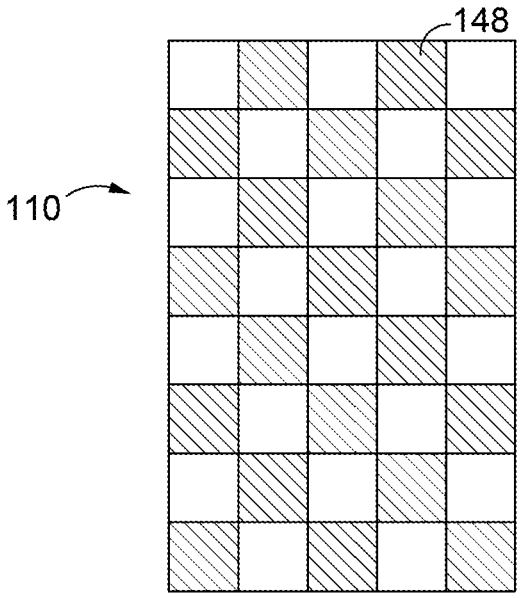
FIG. 4 depicts an alternative view of the knit textile layer of FIG. 2.

In the aspect depicted by FIG. 2, the number of needles with TP-yarn stitches on the first side (e.g., 140 and 142) is the same as the number of needles traversed by a TP float on the second side (e.g., 136 and 138). To further schematically illustrate this symmetry between TP-yarn stitches and TP floats, a plan view of the knit textile layer 110 is depicted in FIG. 4, which also identifies the first portion 148 in the knit wall that includes TP-yarn stitches on the first side. For example, a single course may include two TP-yarn stitches on the first side followed by a TP float that traverses two needle positions on the second side. And the number of needles positions may increase or decrease in accordance with other aspects of this disclosure. For instance, a single course may include more than two TP-yarn stitches on the first side followed by a TP float that traverses more than two needle positions on the second side. In addition, a single course may include a single TP-yarn stitch on the first side followed by a TP float that traverses a single needle position on the second side. By varying the number of TP-yarn stitches and TP floats, a rigidity of a particular region of the knit textile layer can be tuned.

Figure 5:
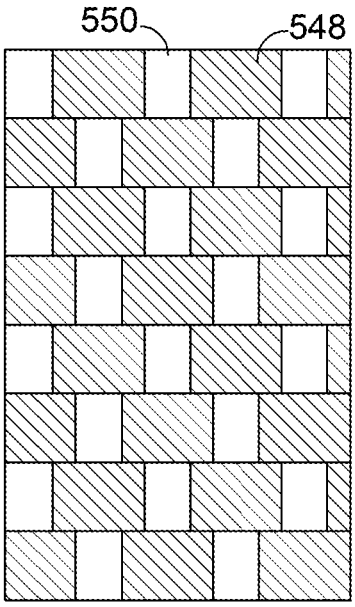
FIG. 5 depicts a schematic view of another knit structure in accordance with an aspect of this disclosure.

In another aspect of the present disclosure, the number needles having TP-yarn stitches and TP float may not be the same. Referring to FIG. 5, a schematic is depicted of an alternative knit structure in which the number of needle positions having TP-yarn stitches (e.g., 548) is larger than the number of needle positions having TP float 550. Alternatively, the number of needle positions having TP-yarn stitches may be smaller than the number of needle positions having TP float, as depicted by the schematic in FIG. 6, which includes a smaller TP-yarn portion 648 and a larger TP float portion 650. As previously indicted, an amount of rigidity of a portion of a knit wall may be regulated by varying the number of TP-yarn stitches and TP floats.

Referring back to FIG. 2, in another aspect of this disclosure, multiple courses that are adjacent to one another (e.g., course 124 and 126) may each include TP yarn. Furthermore, the needle positions that include TP stitches in a first course (e.g., represented by 148) may be offset from needle positions that include TP stitches in a second course (e.g., represented by reference numeral 166). Although FIG. 2 illustratively depicts single course 124 and 126 that are offset, in other aspects a plurality of courses may include a first TP-stitch configuration and a second plurality of stitches may include a second TP-stitch configuration. For example, two or more adjacently positioned courses may include a TP-stitch pattern consistent the course 124, and a subsequent set of two or more adjacently positioned courses may include a TP-stitch pattern consistent with the course 126.

Figure 7:
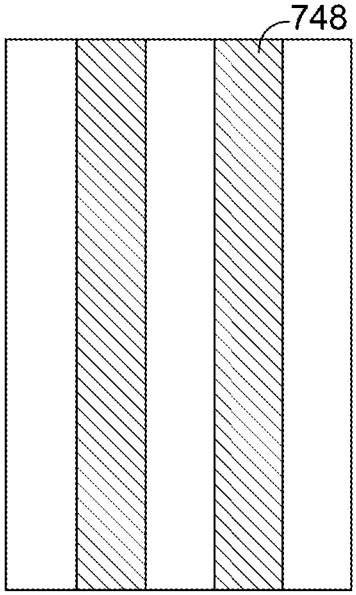
FIG. 7 depicts a schematic view of another knit structure in accordance with an aspect of this disclosure.

In an aspect of this disclosure, by offsetting the TP stitches in adjacent courses (or adjacent sets of courses) elongated rigid regions that span a larger number of courses may be avoided or omitted, such as elongated, rigid TP-yarn "ribs" that align with one or more needle positions. And in other aspects, it may be desirable to incorporate elongated TP-yarn ribs. For example, referring to FIG. 7, a schematic diagram illustrates an alternative knit structure in which a portion 748 includes TP-yarn stitches on the first side that spans a plurality of courses to form an elongated TP rib. The portion 748 may be constructed in a manner similar to the knit structures depicted by the knit structures 122 and 222, or by some other technique.

FIGS. 4-7 depict various manners in which TP yarn may be knit into one or more courses and needles, and in one aspect of this disclosure, these and other techniques are used to try and regulate an extent to which integrated TP yarn may affect the flexibility and rigidity of a knit wall. These properties of a knit wall may contribute to the ability of the knit wall to conform to an underlying structure. For example, in garments and other articles it is advantageous in some instances for the knit wall that constructs the garment or article to shape or conform to a portion of a person engaging with the garment or article. This may be desirable in some garments constructed to conform to the underlying contours of an anatomy, such as a sock, arm sleeve (e.g., elbow region), leg sleeve (e.g., knee or shin region), and the like. Another example includes a shoulder strap or carrying handle for a bag.

In some instances, incorporating heat-treated TP yarn into a series of courses (as illustrated in FIGS. 4-7) may reduce elasticity of the knit wall over the length of those courses, since the melted and solidified TP yarn may coat and lock the elastic properties of other yarns. This reduction in elasticity may be desirable in various contexts. Alternatively, it may be desirable to at least partially regulate the extent to which a knit-wall elasticity is reduced. Accordingly, aspects of this disclosure are directed to knit structures and configurations that at least partially regulate the extent to which elasticity of a knit wall is reduced when TP yarn is integrally knit into the knit wall.

Figure 8:
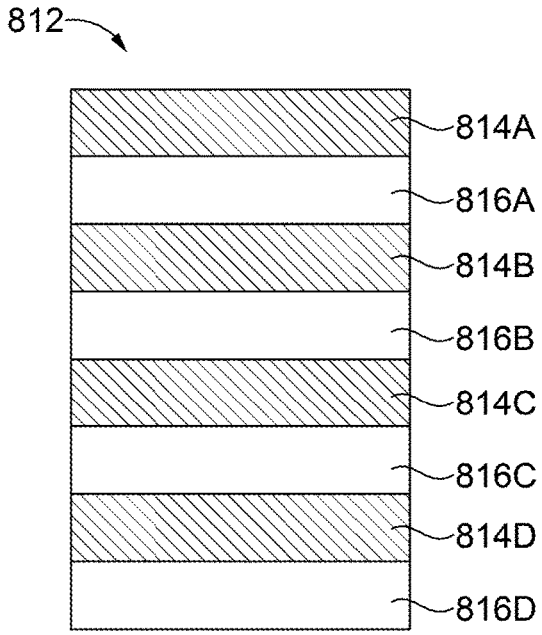
FIG. 8 depicts a schematic view of another knit structure in accordance with an aspect of this disclosure.

Referring now to FIG. 8, a schematic diagram of a knit wall 812 is depicted in which a plurality of courses 814A-816D of the knit wall 812 have been constructed at least partially of a TP yarn. The knit wall 812 may be any of a variety of different knit types, such as single knit, double knit, and the like in which a TP-yarn stitch is arranged at least on the first side (i.e., the TP yarn may be positioned on the second side also). In addition, the knit wall 812 includes a set of courses 816A-816D in which TP yarn is omitted. By applying this knit structure in which non-TP-yarn courses are arranged between two TP-yarn courses, the extent to which elasticity is reduced over the courses is at least partially regulated, since the non-TP-yarn courses can retain more elasticity (as compared with the TP-yarn courses). The knit strategy illustrated by FIG. 8 including non-TP courses may be desirable in various garments that are constructed to stretch when donning, doffing, or wearing the garment, such as, but not limited to, socks, arm sleeves, leg sleeves, gloves, headwear, and the like. Although FIG. 8 illustrates one aspect in which the TP-yarn is integrated into every other course, in other aspects, multiple TP-yarn courses may be adjacently positioned, and likewise, multiple non-TP-yarn courses may be adjacently positioned.

Figure 9:
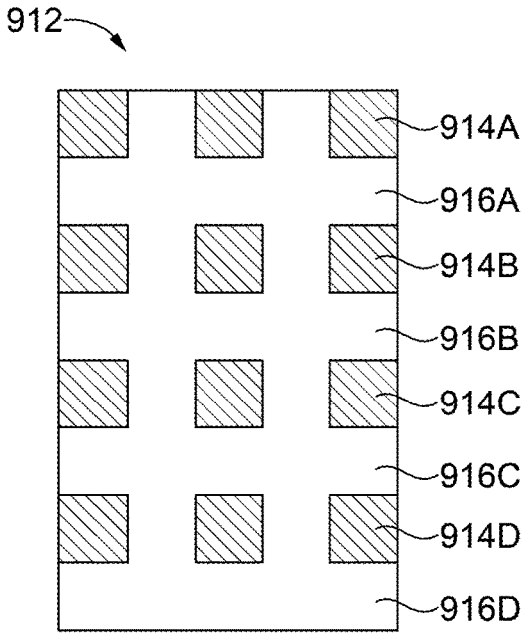
FIG. 9 depicts a schematic view of another knit structure in accordance with an aspect of this disclosure.
Figure 10:
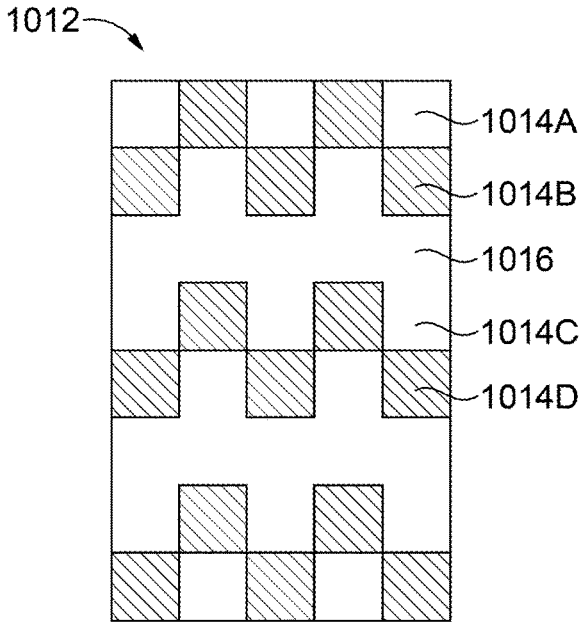
FIG. 10 depicts a schematic view of another knit structure in accordance with an aspect of this disclosure.

Referring now to FIG. 9, another aspect is illustrated in which non-TP-yarn courses 916A-916D are again positioned between TP-yarn courses 914A-914D, but the TP-yarn courses 914A-914D include TP-yarn stitches on the first side of select needle positions. In this respect, the TP-yarn courses 914A-914D may incorporate the knit structures 122 and 222 that were previously described (i.e., the TP yarn 150 includes TP-yarn stitches 152 and 154 positioned on the first side). As such, the knit wall 912 illustrated by FIG. 9 combines some of the techniques for at least partially regulating rigidity by alternating the TP yarn from the first side to the second side and for at least partially regulating elasticity by including non-TP-yarn courses. FIG. 10 depicts a knit wall 1012 incorporating a knitting strategy that is similar to FIG. 9, but the knit wall 1012 includes at least two adjacently positioned TP-yarn courses 1014A and 1014B, which are separated from another set of adjacently positioned TP-yarn courses 1014C and 1014D by a non-TP-yarn course 1016. Although the non-TP-yarn course 1016 is illustrated as a single course, the TP-yarn courses 1014B and 1014C may be separated by a plurality of non-TP-yarn courses.

Figure 11:
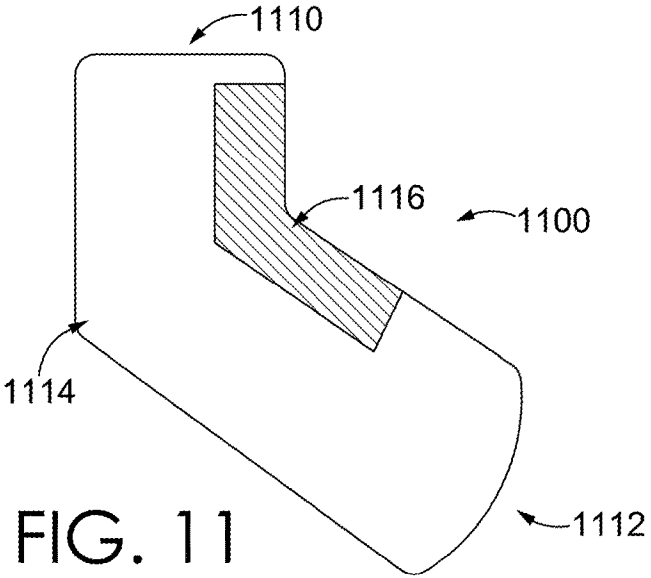

Having described some knit structures that may be used to integrally knit TP yarn into a knit wall, reference is now made to FIGS. 11-14, which illustrate various garments that include knit walls at least partially constructed of TP-yarn. For example, FIG. 11 depicts a sock 1100 that includes an open end 1110, a closed end 1112, and a heel pocket 1114 positioned between the open end 1110 and the closed end 1112. The heel pocket 1114 is generally on the posterior portion of the sock and is formed by a series of reciprocating courses. In addition, the sock 1100 includes a knit wall having a portion or zone 1116 that includes TP yarn and that is positioned on the anterior portion generally opposite to the heel pocket 1114. In addition, the zone 1116 generally extends from a portion of the sock 1100 configured to align with a top of the wearer's foot to a portion of the sock 1100 configured to align with a lower portion of a wearer's shin. This sock 1100 is merely exemplary, and the sock 1100 may be longer and include a larger TP-yarn zone.

The zone 1116 may represent a placement of TP yarn that provides some desired characteristic, such as increased wear resistance, abrasion resistance, support, reduced elasticity, and the like. In addition, the zone 1116 may include a zone that is commonly exposed to repeated lacing of a shoe, as well as compression caused by lacing of the shoe. Some activities in which a wearer engages (such as basketball and hiking) may cause greater wear and abrasion at the zone 1116, either by the nature of the activity, by the nature of the shoes, or a combination thereof. As such, the sock 1100 may be an activity-focused sock that includes other characteristics beneficial to a wearer engaging in that activity.

Figure 12:
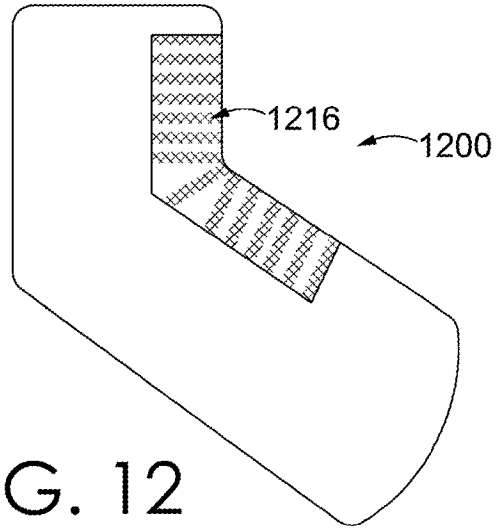
FIGS. 11-14 each depicts an exemplary garment in accordance with an aspect of this disclosure.

Although the zone 1116 is generally identified by a single hatching in FIG. 11, the zone 1116 may include one or more of the knitting structures depicted in, and described with respect to, FIGS. 2-10. For example, FIG. 12 depicts another sock 1200 having a TP-yarn zone with a knit strategy similar to FIG. 8 with non-TP-yarn courses alternating with TP-yarn courses. In this sense, the reduction in elasticity that may arise from integrating TP-yarn into the zone 1216 may be at least partially regulated by position and spacing of the TP-yarn courses and non-TP-yarn courses.

Figure 6:
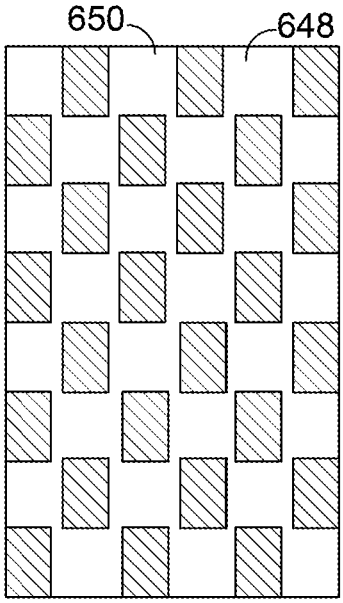
FIG. 6 depicts a schematic view of another knit structure in accordance with an aspect of this disclosure.
Figure 13:
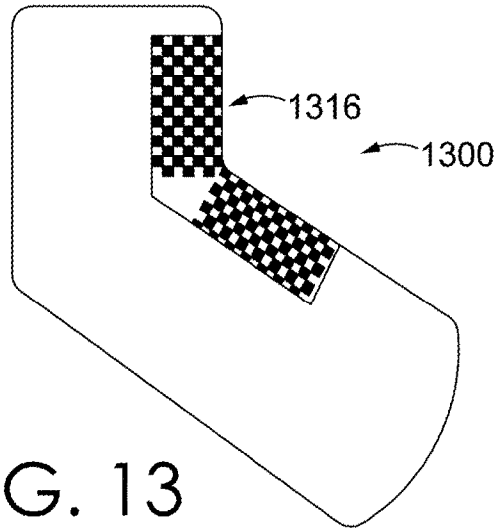

In another example depicted by FIG. 13, a sock 1300 includes a similarly positioned TP-yarn zone 1316 having a knit strategy similar to FIGS. 4-6 in which TP-yarn crosses over between the first side (outward facing) and the second side (inward facing and towards wearer in an in-use arrangement) as the TP-yarn is knit into a single course. As such, the reduction in rigidity that may arise from integrating TP-yarn into the zone 1316 may be at least partially regulated, which may improve a fit of the sock 1300 around the foot, ankle, and shin.

Figure 14:
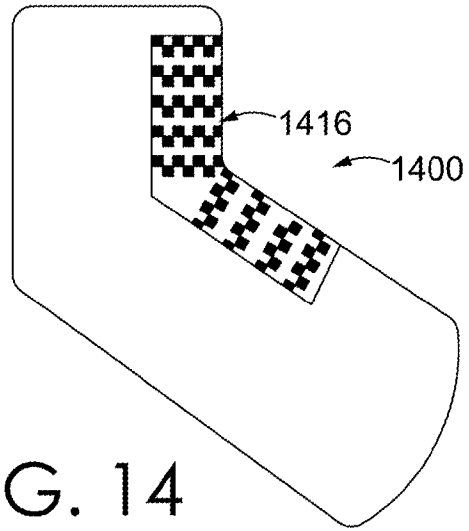

In a further example depicted by FIG. 14, a sock 1400 includes a similarly positioned TP-yarn zone 1416 having a knit strategy similar to FIG. 10, which combines aspects of the knit strategies depicted by (and described with respect to) FIGS. 4-9. As such, the TP-yarn crosses over between the first side (outward facing) and the second side (inward facing and towards wearer in an in-use arrangement) as the TP-yarn is knit into a single course. In addition, non-TP-yarn courses alternate between one or more TP-yarn courses. As such, the reduction in rigidity and elasticity that may arise from integrating TP-yarn into the zone 1416 may be at least partially regulated, which may improve a fit of the sock 1400 around the foot, ankle, and shin, and may increase the ease of donning and doffing.

In other aspects of the present invention, TP yarn that is heat treatable, or that has been heat treated by melting and solidifying, may be incorporated into other regions of a sock. For example, TP yarn may be incorporated into a medial side of the sock, a lateral side of the sock, an anterior shin region, and any combination thereof. Constructing a sock to include thermoset TP yarn in these regions may provide various features, such as impact attenuation in an ankle region, a shin region, or both an ankle and a shin region. For instance, in FIGS. 11-14 although the respective zones are depicted having TP yarn, in other aspects, TP yarn may be integrally knit into other zones of the sock. However, in other aspects the zones identified in FIGS. 11-14 may include TP yarn and other portions of the sock that form a perimeter around the identified zones may omit the TP yarn.

In further aspects, TP yarn may be constructed into other garments, including shirts, pants, arm sleeves, calf sleeves, gloves, headwear, footwear, protective garments, base layers, outerlayers, and the like. Selective placement of TP yarn may be based on various factors, such as regions that would benefit from abrasion resistance and/or regions that may afford impact attenuation to an underlying structure or wearer. For example, in a leg garment that covers the knee or hips, TP yarn may be incorporated into these zones to provide additional abrasion resistance and impact attenuation. In addition, TP yarn may be constructed into bags or athletic equipment and positioned in select zones for abrasion resistance, added impact attenuation, friction reduction, and the like.

Additional Aspects of TP-Yarn

In further aspects, any of the yarns discussed herein may be mono-filament yarns or multi-filament yarns, and in other aspects, the yarns may be filament yarns or spun yarns. In some aspects, the yarns may be formed using conventional techniques including, but not limited to, melt-spinning, solution spinning, or electropinning. Further, the yarns may include synthetic and natural textile filaments of varying sizes that may or may not be suitable for use in a commercial knitting machine.

In additional aspects, the thermoplastic polymer composition may be included as a coating on the TP-yarn. In other aspects, the thermoplastic polymer composition can be included as one or more filaments in the TP-yarn, and in further aspects, the TP-yarn may only include filaments comprising the thermoplastic polymer composition and may form mono-filament or multi-filament yarn. Moreover, the thermoplastic polymer composition may comprise any weight percentage of the TP yarn required to impart a desired characteristic, property, or effect on the TP yarn and a knit wall and in some aspects may comprise about 25 wt. % to about 99 wt. % of the TP yarn. In certain aspects, the TP yarn may also include one or more conventional additives found in yarns that comprise polymeric materials.

As discussed herein, the thermoplastic polymer composition may include a melting temperature within an exemplary range from lowest of about 85° C. to highest of about 230° C. However, in other aspects, the melting temperature may be lower or higher than the exemplary range and may include respective melting temperatures of any of the thermoplastic polymer compositions discussed herein and described in detail below.

In certain aspects, the thermoplastic polymer composition may include one or more thermoplastic polymers. In various aspects, the thermoplastic polymers may include one or more polymers selected from the group consisting of polyesters, polyethers, polyamides, polyurethanes and polyolefins. In aspects, the thermoplastic polymers may include one or more polymers selected from the group consisting of polyesters, polyethers, polyamides, polyurethanes, and combinations thereof.

In one or more aspects, the thermoplastic polymers may include one or more polyesters. In such aspects, the polyesters may include polyethylene terephthalate (PET). In certain aspects, the thermoplastic polymers may include one or more polyamides. In such aspects, the polyamides may include nylon 6,6, nylon 6, nylon 12, and combinations thereof. In aspects, the thermoplastic polymers may include one or more polyurethanes.

In various aspects, the thermoplastic polymers may include one or more co-polymers. In certain aspects, the thermoplastic polymers may include one or more co-polymers selected from the group consisting of co-polyesters, co-polyethers, co-polyamides, co-polyurethanes, and combinations thereof. In one or more aspects, the thermoplastic polymers may include one or more co-polyesters. In certain aspects, the thermoplastic polymers may include one or more co-polyethers. In aspects, the thermoplastic polymers may include one or more co-polyamides. In certain aspects, the thermoplastic polymers may include one or more co-polyurethanes. In one aspect, the thermoplastic polymers may include one or more polyether block amide (PEBA) co-polymers In various aspects the thermoplastic polymer may include one or more of a thermoplastic polyurethane, a thermoplastic polyamide, a thermoplastic polyester, and a thermoplastic polyolefin. It should be understood that other thermoplastic polymeric materials not specifically described herein are also contemplated for use in the thermoplastic polymer composition.

Commercially available thermoplastic polyurethanes having greater hydrophilicity suitable for the present use include, but are not limited to those under the tradename "TECOPHILIC", such as TG-500, TG-2000, SP-80A-150, SP-93A-100, SP-60D-60 (Lubrizol, Countryside, Ill.), "ESTANE" (e.g., ALR G 500, or 58213; Lubrizol, Countryside, Ill.).

From the foregoing, it will be seen that this subject matter is adapted to attain the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since possible alternatives of the subject matter may be made without departing from the scope thereof, it is to be understood that all matter herein set forth or shown in the accompanying drawings is to be interpreted as illustrative and not in a limiting sense.

The invention claimed is:

1. An article comprising:

a knit wall that is constructed of a plurality of knit courses and that includes a first side and a second side, wherein each knit course of the plurality of knit courses includes a plurality needle positions; and a thermoplastic yarn integrally knit into a first knit course of the plurality of knit courses, wherein the thermoplastic yarn includes a first portion that is integrally knit into the first knit course at a first subset of needle positions and that is positioned on the first side, wherein the thermoplastic yarn includes a second portion that extends through a thickness of the knit wall and from the first side to the second side, and wherein the thermoplastic yarn includes a third portion that traverses a second subset of needle positions and that is positioned on the second side.

2. The article of claim 1, wherein the knit wall includes a plaiting yarn and a laid-in yarn, wherein the thermoplastic yarn comprises a first body yarn, and wherein the first portion includes one or more stitches formed of the thermoplastic yarn and arranged on the first side.

3. The article of claim 2, wherein the third portion includes a floated length of the thermoplastic yarn arranged on the second side.

4. The article of claim 3 further comprising a second body yarn knit into the first knit course, wherein the second body yarn is floated on the second side at the first subset of needle positions.

5. The article of claim 4, wherein the second body yarn includes one or more stitches formed on the first side at the second subset of needle positions.

6. The article of claim 5, wherein the second body yarn includes one or more terry loops formed on the second side at the second subset of needle positions.

7. The article of claim 5 further comprising a second knit course of the plurality of knit courses arranged adjacently to the first knit course, wherein the thermoplastic yarn is knit into the second knit course, wherein, in the second knit course, the thermoplastic yarn is floated on the second side at the first subset of needle positions, and wherein, in the second knit course, the thermoplastic yarn forms one or more stitches on the first side at the second subset of needle positions.

8. The article of claim 7, wherein the second body yarn is knit into the second knit course, wherein in the second knit course, the second body yarn is floated on the second side at the second subset of needle positions, and wherein in the second knit course, the second body yarn forms one or more stitches on the first side at the first subset of needle positions.

9. The article of claim 5, wherein the thermoplastic yarn and the second body yarn form an alternating pattern at the first subset of needle positions and the second subset of needle positions, and wherein the alternating pattern is repeating along the first knit course.

10. The article of claim 9, wherein the first subset of needle positions includes a first quantity of needle positions that is equal to, or less than, about five needle positions, and wherein the second subset of needle positions includes a second quantity of needle positions that is equal to, or less than, about five needle positions.

11. The article of claim 1, wherein the thermoplastic yarn is in a pre-thermoformed state, prior to being heat-treated.

12. The article of claim 1, wherein the thermoplastic yarn is in a thermoformed state.

13. The article of claim 1, wherein the article includes a closed end, an open end, and a heel pocket formed of reciprocating courses positioned on a posterior side of the article, and wherein the thermoplastic yarn is arranged in an anterior portion of one or more courses opposite to the heel pocket.

14. An article comprising:

a knit tubular wall that is constructed of a plurality of knit courses including a first set of knit courses, a second set of knit courses, and a third set of knit courses, wherein the first set of knit courses, the second set of knit courses, and the third set of knit courses are adjacently arranged such that the second set of knit courses is positioned directly between the first set of knit courses and the third set of knit courses; and a thermoplastic yarn that is integrally knit into the first set of knit courses and the third set of knit courses and that is omitted from the second set of knit courses, wherein the thermoplastic yarn includes a first portion that is positioned on a first side of the knit tubular wall, wherein the thermoplastic yarn includes a second portion that extends through a thickness of the knit tubular wall from the first side to a second side of the knit tubular wall, and wherein the thermoplastic yarn includes a third portion that is positioned on the second side of the knit tubular wall.

15. The article of claim 14, wherein each set of knit courses included among the first set of knit courses, the second set of knit courses, and the third set of knit courses comprises a respective quantity of courses, and wherein the respective quantity of courses of the second set of knit courses is equal to, or less than, five courses.

16. The article of claim 15, wherein the first set of knit courses and the third set of knit courses each includes the respective quantity of courses equal to, or less than, 30 courses.

17. The article of claim 15, wherein the first set of knit courses and the third set of knit courses each includes the respective quantity of courses equal to, or less than, five courses.

18. The article of claim 14, wherein the article includes a closed end, an open end, and a heel pocket formed of reciprocating courses positioned on a posterior side of the article, and wherein the thermoplastic yarn is arranged in an anterior portion of one or more courses opposite to the heel pocket.

19. An article comprising:

a knit wall that is constructed of a plurality of knit courses and that includes a first side and a second side, wherein each knit course of the plurality of knit courses includes a plurality needle positions, wherein the plurality of knit courses includes a first knit course, a second knit course, and a third knit course; and wherein the second knit course is positioned between the first knit course and the third knit course; and a thermoplastic yarn that is integrally knit into the first knit course and the third knit course and that is omitted from the second knit course, wherein the thermoplastic yarn includes a first portion that is integrally knit into the first knit course at a first subset of needle positions and that is positioned on the first side, wherein the thermoplastic yarn includes a second portion that extends through a thickness of the knit wall and from the first side to the second side, and wherein the thermoplastic yarn includes a third portion that traverses a second subset of needle positions and that is positioned on the second side.

20. The article of claim 19, wherein the article includes a closed end, an open end, and a heel pocket formed of reciprocating courses positioned on a posterior side of the article, and wherein the thermoplastic yarn is arranged in an anterior portion of one or more courses opposite to the heel pocket.

* * * * *